US010314753B2

(12) United States Patent
Klink et al.

(10) Patent No.: US 10,314,753 B2
(45) Date of Patent: Jun. 11, 2019

(54) SYSTEMS, METHODS, AND DEVICES FOR FLUIDIZING A FLUIDIZABLE MEDIUM

(71) Applicant: Hill-Rom Services, Inc., Batesville, IN (US)

(72) Inventors: Kristopher Klink, Indianapolis, IN (US); Frank Sauser, Cincinnati, OH (US); Charles A. Lachenbruch, Batesville, IN (US); John Murphy, Goose Creek, SC (US); Irvin J. Vanderpohl, III, Greensburg, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/329,746

(22) Filed: Jul. 11, 2014

(65) Prior Publication Data

US 2015/0047126 A1 Feb. 19, 2015

Related U.S. Application Data

(63) Continuation of application No. 13/246,886, filed on Sep. 28, 2011, now abandoned.

(51) Int. Cl.
*A61G 7/057* (2006.01)
*A61G 7/018* (2006.01)

(52) U.S. Cl.
CPC ..... *A61G 7/05746* (2013.01); *A61G 7/018* (2013.01); *A61G 2203/30* (2013.01); *A61G 2203/34* (2013.01); *Y10T 137/0318* (2015.04); *Y10T 137/0391* (2015.04)

(58) Field of Classification Search
CPC ..... A61G 7/05746; A61G 7/018; A61G 2203/34; A61G 2203/30; Y10T 137/0391; Y10T 137/0318
USPC ..... 5/689, 655.4, 644, 654, 702, 911
See application file for complete search history.

(56) References Cited

U.S. PATENT DOCUMENTS 4,609,854 A 9/1986 Yamamoto et al.
4,914,760 A 4/1990 Hargest
4,942,635 A * 7/1990 Hargest ..... A61G 7/05746 5/689
5,168,591 A 12/1992 Hakamiun et al.
5,402,542 A 4/1995 Viard
(Continued)

FOREIGN PATENT DOCUMENTS

EP 0332242 9/1989

OTHER PUBLICATIONS

Robert P. Hesketh, Fluidization, Prepared for the Process Fluid Transport, 12.

(Continued)

*Primary Examiner* — Fredrick C Conley
(74) *Attorney, Agent, or Firm* — Barnes & Thornburg LLP

(57) ABSTRACT

A system for fluidizing a fluidizable medium includes a person support structure, fluid supply, sensor, and controller. The person support structure includes a chamber containing a fluidizable medium and a plenum in fluid communication with the chamber. The fluid supply is in fluid communication with the plenum. The sensor is configured to sense a pressure of fluid in the plenum. The controller is configured to control the operation of the fluid supply as a function of the fluid pressure within the plenum to achieve a desirable level of fluidization of the fluidizable medium.

20 Claims, 8 Drawing Sheets

(56) References Cited

U.S. PATENT DOCUMENTS

| | | | | |
|---|---|---|---|---|
| 5,539,943 | A * | 7/1996 | Romano | A61G 7/05746 5/655.5 |
| 5,623,736 | A | 4/1997 | Soltani et al. | |
| 6,430,765 | B1 | 8/2002 | Ozarowski et al. | |
| 6,624,419 | B2 | 9/2003 | Ozarowski et al. | |
| 7,634,937 | B2 | 12/2009 | Burdett et al. | |
| 2002/0157187 | A1 * | 10/2002 | Ozarowski | A61G 7/05746 5/689 |
| 2008/0235872 | A1 | 10/2008 | Newkirk et al. | |
| 2010/0088825 | A1 * | 4/2010 | Howell | A61G 7/05746 5/689 |
| 2011/0035057 | A1 | 2/2011 | Receveur et al. | |
| 2011/0072583 | A1 | 3/2011 | McNeely et al. | |
| 2011/0113560 | A1 | 5/2011 | Receveur | |
| 2013/0296769 | A1 | 11/2013 | Howell et al. | |
| 2014/0000039 | A1 | 1/2014 | Sauser | |

OTHER PUBLICATIONS

European Search Report, European Application No. 16207157.5, completed Mar. 22, 2017, (8 pages).

* cited by examiner

SYSTEMS, METHODS, AND DEVICES FOR FLUIDIZING A FLUIDIZABLE MEDIUM

BACKGROUND OF THE DISCLOSURE

This disclosure relates generally to fluidized person support structures. More particularly, but not exclusively, one illustrative embodiment relates to fluidizing a fluidizable medium of a fluidized person support structure. While various fluidized person support structures have been developed, there is still room for improvement. Thus a need persists for further contributions in this area of technology.

SUMMARY OF THE DISCLOSURE

In one illustrative embodiment, a fluidized person support structure comprises a fluidizable medium, a fluid supply, a sensor, and a controller. The fluid supply is configured to supply fluid that flows through the fluidizable medium. The controller is electrically coupled to the fluid supply and the sensor and is configured to calculate a desirable flow rate as a function of at least one input from the sensor as the rate at which fluid flows through the fluidizable medium is changed. The controller causes the fluid supply to supply fluid at the desirable flow rate.

In another illustrative embodiment, a fluidized person support structure comprises a fluidizable medium, a fluid supply, an input device, and a controller. The fluid supply is configured to supply fluid that flows through the fluidizable medium. The controller is configured to receive an input from the input device and calculate a fluidization threshold as a function of the input. The controller controls the fluid supply as a function of the fluidization threshold.

In another illustrative embodiment, a fluidized person support structure comprises a fluidizable medium, a fluid supply, a sensor, and a controller. The fluid supply is configured to supply fluid that flows through the fluidizable medium. The sensor is configured generate a signal indicative of a level of fluidization of the fluidizable medium. A physical property of the sensor changes as the fluidizable medium is fluidized by the fluid. The controller is configured to receive an input from the sensor and control the fluid supply as a function of the input.

In another illustrative embodiment, a method of fluidizing a fluidizable medium comprises the steps of: identifying a fluidization threshold of the fluidizable medium; and increasing a rate at which fluid flows through the fluidizable medium as a function of the fluidization threshold.

In another illustrative embodiment, a method of fluidizing a fluidizable medium comprising the steps of: changing a rate at which fluid flows through the fluidizable medium; sensing a parameter indicative of a level of fluidization of the fluidizable medium; determining a desirable flow rate as a function of the sensed parameter; and controlling a fluid supply as a function of the desirable flow rate.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
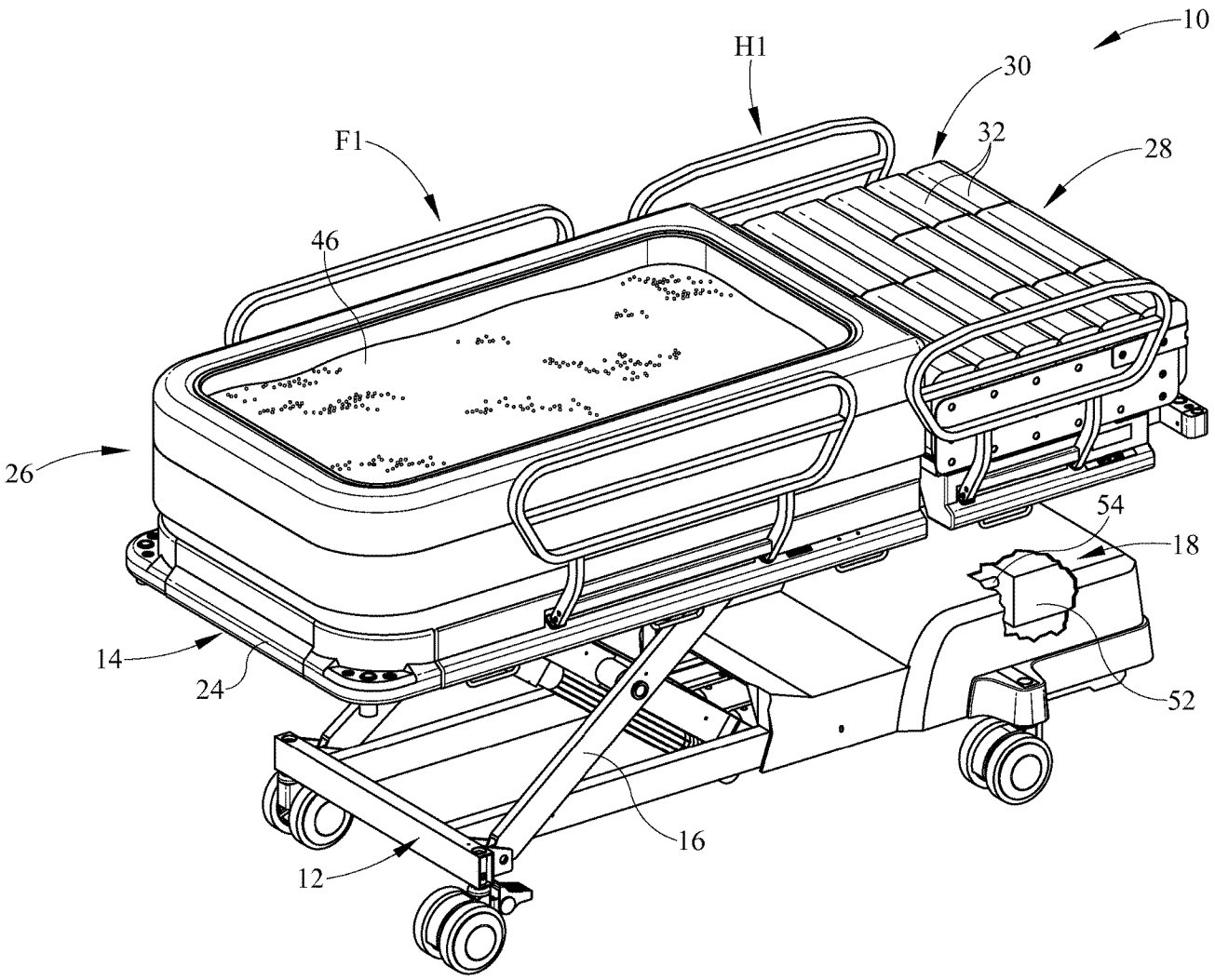
FIG. 1 is a perspective side view of a fluidized person support apparatus according to an illustrative embodiment.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

A person support apparatus 10 according to one illustrative embodiment of the current disclosure is shown in FIGS. 1-8. The person support apparatus 10 is a fluidized hospital bed and includes a head section H1, where the head of a person (not shown) can be positioned, and a foot section F1, where the feet of a person (not shown) can be positioned. The person support apparatus 10 includes a lower frame 12, an upper frame 14, a plurality of supports 16 supporting the upper frame 14 on the lower frame 12, and a fluidization system 18.

Figure 2:
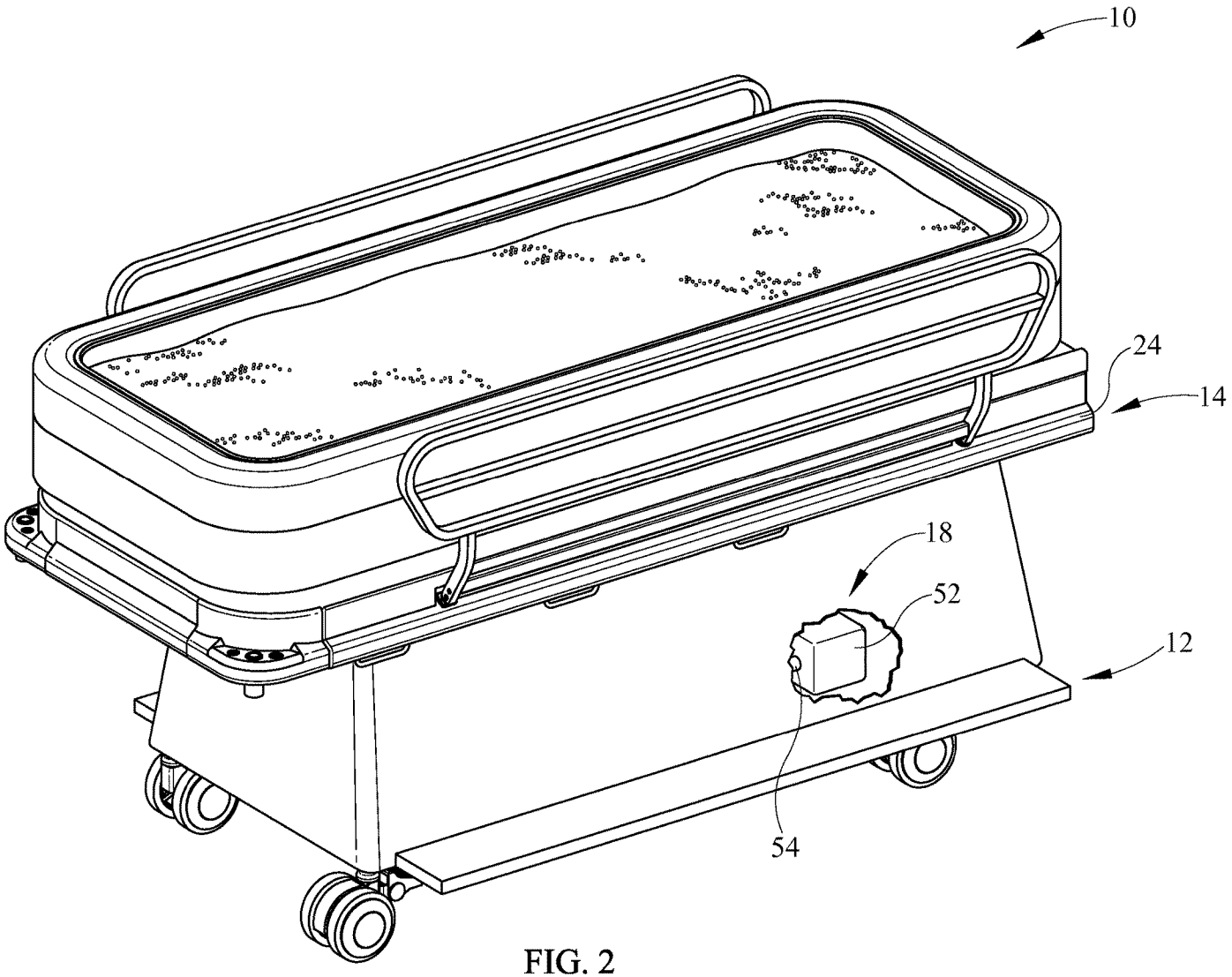
FIG. 2 is a perspective side view of the fluidized person support apparatus according to another illustrative embodiment.

The supports 16 are coupled to the lower frame 12 and the upper frame 14 and movably support the upper frame 14 above the lower frame 12 as shown in FIG. 1. In one illustrative embodiment, the supports 16 are lift mechanisms 16 with a lift driver (not shown) that causes the lift mechanisms 16 to expand and/or contract to raise and/or lower the upper frame 14 with respect to the lower frame 12. In another illustrative embodiment, the supports 16 fixedly support the upper frame 14 above the lower frame 12 as shown in FIG. 2.

The upper frame 14 includes an upper frame weldment 24 that supports a tank assembly 26 or container 26 and a head end support assembly 28 as shown in FIG. 1. In some contemplated embodiments, the upper frame 14 does not include a head end support assembly 28 and instead, the tank assembly 26 that extends the length of the upper frame 14 as shown in FIG. 2. The head end support assembly 28 is configured to support a person's head and/or torso while the tank assembly 26 is configured to support the pelvic region and lower extremities of a person. The head end support assembly 28 includes a person support surface 30 or mattress 30 composed of fluid bladders 32 and is configured to pivot with respect to the tank assembly 26 to move a person supported on the person support apparatus 10 between a substantially horizontal position and a reclined or elevated position. In some contemplated embodiments, the person support surface 30 includes foam (not shown) and/or a combination of foam and fluid bladders 32.

The tank assembly 26 includes a tank base 34, a tank liner 36, a tank bladder 38, and a filter cover 40 or gas permeable cover 40 as shown in FIGS. 3-8. In one illustrative embodiment, the tank base 34 and the tank liner 36 are made of a low or substantially no air-loss material, such as, for example, a polyurethane-backed nylon fabric material, and the tank bladder 38 is composed of a substantially no air loss polymeric material and filled with a fluid, such as, air. The tank base 34 is coupled to the upper frame weldment 24 by tank fasteners (not shown) and includes an inlet 42 that couples with the fluid supply system 18. The tank liner 36 and the tank bladder 38 are coupled together to form the sides of the tank assembly 26. The tank base 34 is coupled with the tank liner 36 and the tank bladder 38 to define an opening 39 opposite the tank base 34.

The filter cover 40 or filter sheet 40 is positioned over the opening 39 and is coupled to the tank liner 36 as shown in FIGS. 3-8. The cover 40 is coupled to the tank liner 36 by fasteners can be zippers, buttons, snaps, turn-buttons, hook and loop fasteners, or other fasteners. The tank base 34, the tank liner 36, the tank bladder 38, and the filter cover 40 cooperate to define a chamber 44 there between that contains a fluidizable medium 46 and a diffuser 48 or gas permeable support 48. The filter cover 40 is configured to allow fluid, such as, bodily fluids and air, to pass there through while preventing the fluidizable medium 46 from passing through. The filter cover 40 is also configured to prevent hammocking from occurring when a person is supported thereon and the fluidizable medium 46 is fluidized.

The diffuser 48 is configured to support the fluidizable medium 46 in the chamber 44 and provide substantially uniform fluid flow to the fluidizable medium 46 as shown in FIGS. 3-8. The diffuser 48 is permeable to the fluid supplied by the fluidization system 18 and is configured to prevent the fluidizable medium 46 from passing there through. The diffuser 48 is positioned proximate the tank base 34 and cooperates with the tank base 34 to define a chamber 50 or plenum 50. The plenum 50 receives fluid from the fluidization system 18 through the inlet 42 and is configured to substantially equalize the pressure of the fluid within the plenum 50 across the diffuser 48 so that the fluid is communicated substantially uniformly through the diffuser 48. The fluid in the plenum 50 is pressurized depending on the fluid flow rate from the fluidization system 18 and the porosity of the diffuser 48.

Figure 3:
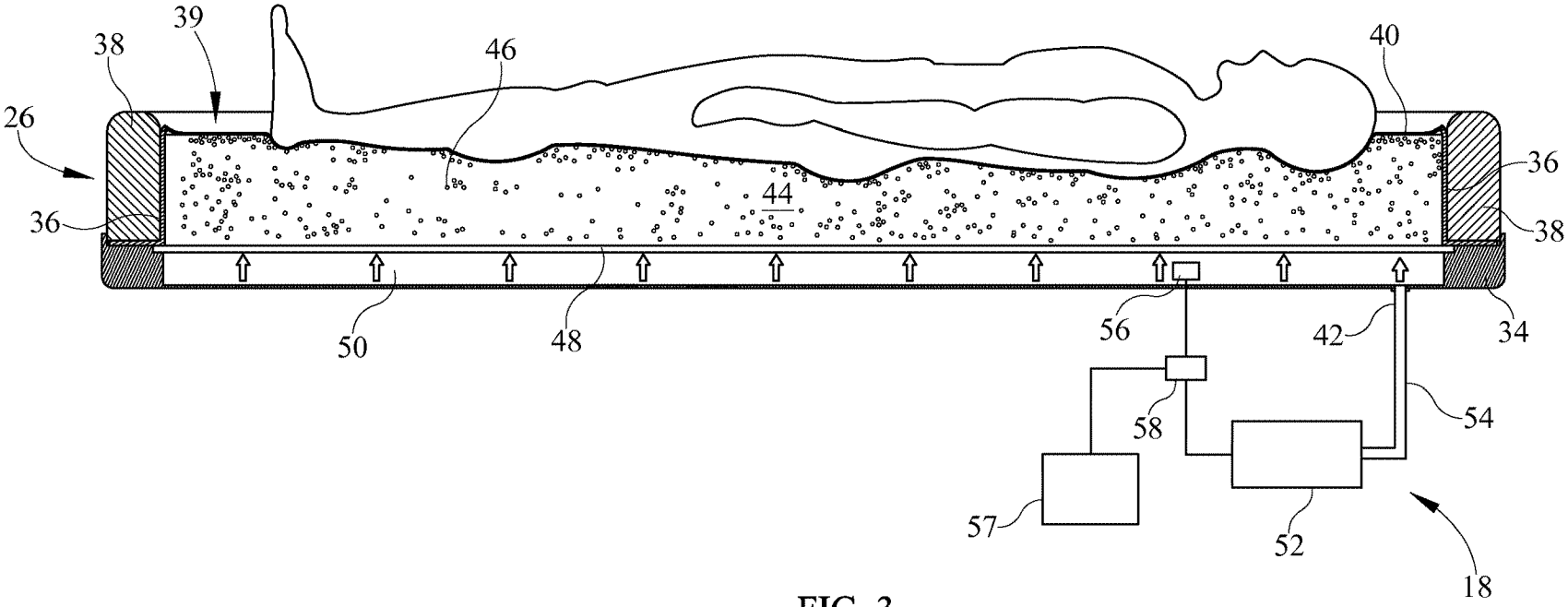
FIG. 3 is a cross-sectional side view of the person support apparatus of FIG. 2 along the width of the person support apparatus showing a profile of the diffuser.
Figure 4:
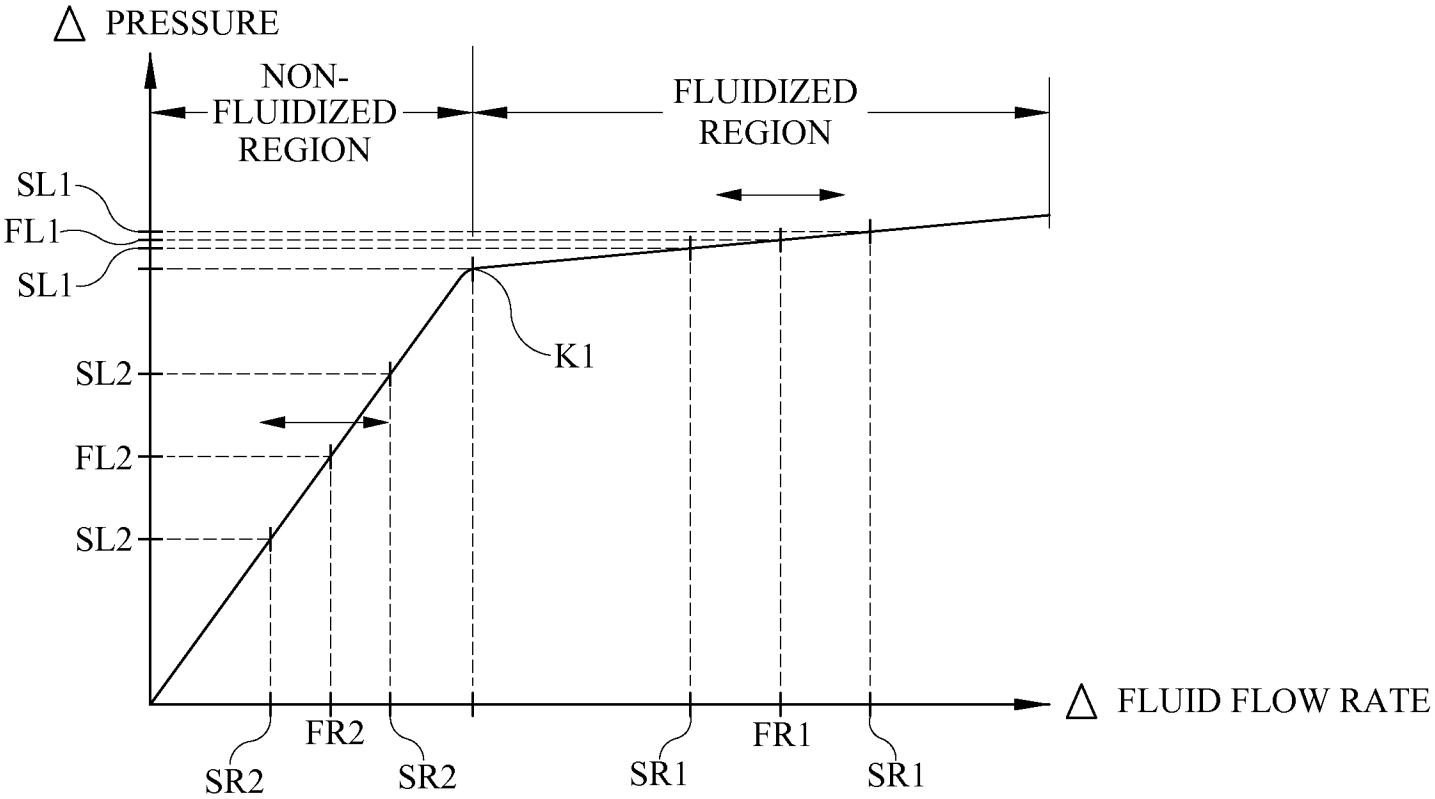
FIG. 4 is a graph of the plenum pressure as a function of fluid flow rate.

The volume between the diffuser 48 and the filter cover 40 is filled with the fluidizable medium 46 as shown in FIGS. 3-8. Generally speaking, fluidization of the fluidizable medium 46 follows a standard pressure drop v. fluid flow rate curve for fluidization of a bed of solid particles as shown in FIG. 4. The pressure drop is proportional to the weight of the bed of particles and the rate at which fluid flows through the particles. Fluid flowing through the bed of particles exerts a force on the particles, and when the force exceeds the weight of the bed of particles, the particles become suspended and begin to exhibit liquid-like characteristics. The portion of the graph at which this occurs is the fluidization threshold or knee K1 of the curve. Increasing the fluid flow rate above the knee K1 into the fluidized region causes the bed of particles to expand and bubble. The change in pressure drop in this region is relatively small for changes in fluid flow rate. Conversely, decreasing the fluid flow rate below the knee K1 into the non-fluidized region causes the particles to stop moving and the bed of particles becomes fixed. The change in pressure drop in this region is relatively large for changes in the fluid flow rate when compared to the fluidized region.

The fluidizable medium 46 is composed of small particles that can vary in shape in size. In one illustrative embodiment, the fluidizable medium 46 are spherical silica beads of the type commonly employed in air fluidized bead person support systems. In some contemplated embodiments, the fluidizable medium 46 can range in size from about 50 to about 150 microns in diameter. A new batch of the fluidizable medium 46 having a depth of about 9 inches requires about 25-35 cubic feet per minute ("CFM") to reach the fluidization threshold and about 40-65 CFM to provide a desirable level of fluidization.

The fluidization system 18 is configured to communicate fluid, such as, air, through the diffuser 48 to fluidize the fluidizable medium 46. The fluidization system 18 includes a fluid supply 52, a hose 54, a sensor 56, an input device 57, and a controller 58 as shown in FIGS. 1-3. In one illustrative embodiment, the fluid supply 52 is an air blower coupled to the lower frame 12 and configured to supply air through the hose 54 to the plenum 50. In some contemplated embodiments, the fluid supply 52 can be removably coupled to or integrated into the upper frame 14 and/or the supports 16. In other contemplated embodiments, the fluid can be remotely supplied, such as, by a head wall unit (not shown) or fluid outlet (not shown) within a facility, such as, an air outlet. In still other contemplated embodiments, the temperature of the fluid communicated by the fluid supply 52 can be increased/decreased by a heating/cooling device (not shown).

Figure 5:
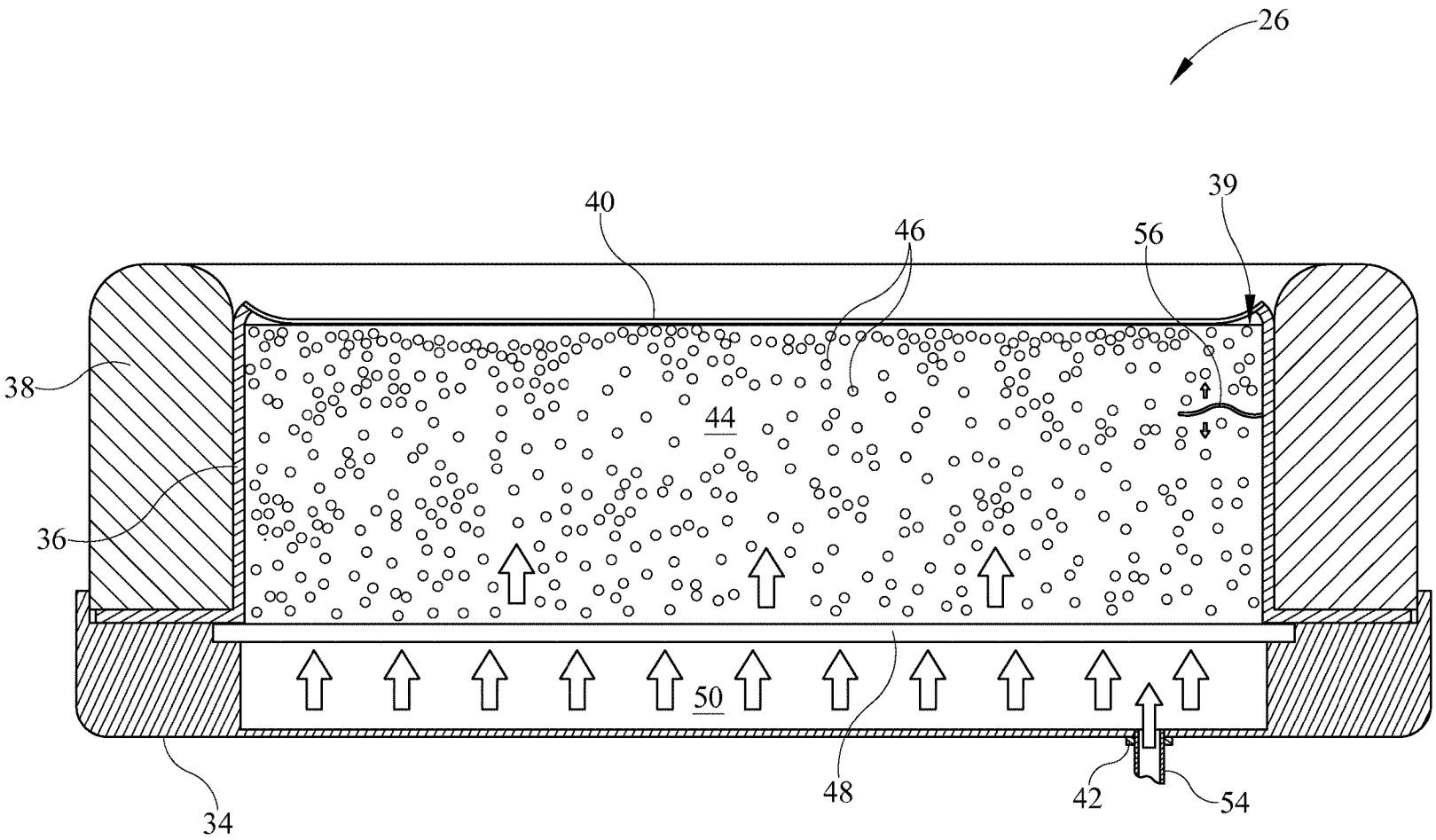
FIG. 5 is a cross-sectional side view of the person support apparatus of FIG. 2 along the width of the person support apparatus showing a flexible sensor positioned in the fluidizable medium.

The sensor 56 is configured to measure an operational parameter of the person support apparatus 10 indicative of a level of fluidization of the fluidizable medium 46 as shown in FIGS. 5-8. The word "indicative" as used herein means indicating an actual level of fluidization or used as a variable in the calculation of the level of fluidization. The sensor 56 can be configured to measure a variety of parameters, including, but not limited to, the fluid flow rate, the amount of current drawn by the fluid supply 52, an amount of movement of the fluidizable medium 46, a fluid pressure, pressures within the fluidizable medium, and other operational parameters. In one illustrative embodiment, the sensor 56 includes a flexible sensor coupled to the tank assembly 26 and positioned in the fluidizable medium 46 as shown in FIG. 5. In some contemplated embodiments, the flexible sensor 56 could be coupled to the diffuser 48, the filter cover 40, and/or the tank liner 36. The flexible sensor 56 is configured to maintain substantially the same resistance when the fluidizable medium 46 is not fluidized and change its resistance as it is moved by the fluid and/or the fluidizable medium 46 when the fluidizable medium 46 is fluidized. The magnitude of the changes in resistance increase as the fluidization increases.

Figure 6:
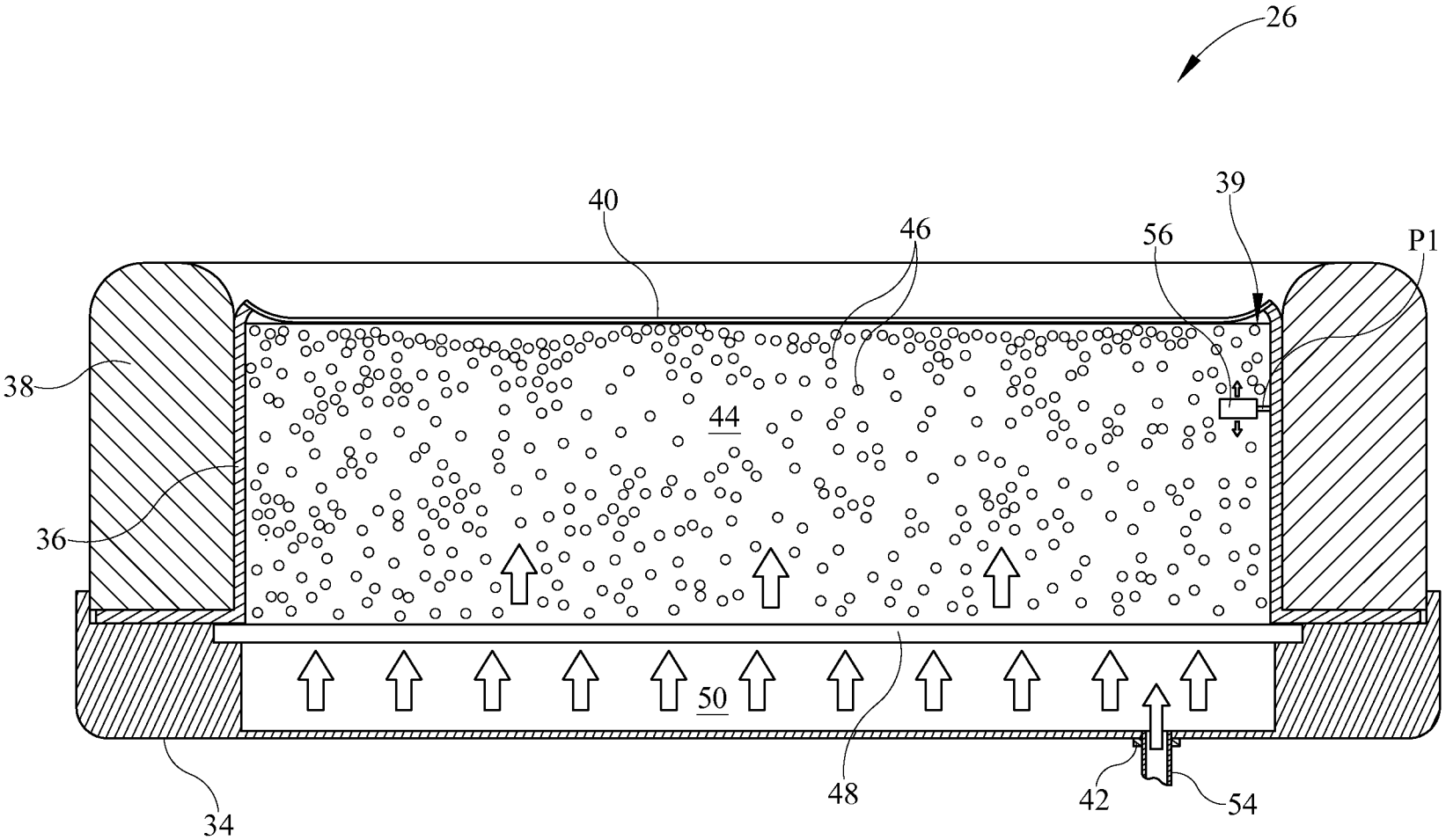
FIG. 6 is a cross-sectional side view of the person support apparatus of FIG. 2 along the width of the person support apparatus showing an accelerometer positioned in the fluidizable medium.

In another illustrative embodiment, the sensor 56 includes an accelerometer coupled to the tank assembly 26 and positioned in the fluidizable medium 46 as shown in FIG. 6. The accelerometer 56 is coupled to a post P1 that is coupled to the tank liner 36 and is configured to be moved by the fluidizable medium 46 and/or the fluid when the fluidizable medium 46 is fluidized. In some contemplated embodiments, the accelerometer 56 could be coupled to the diffuser 48 and/or the filter cover 40.

Figure 7:
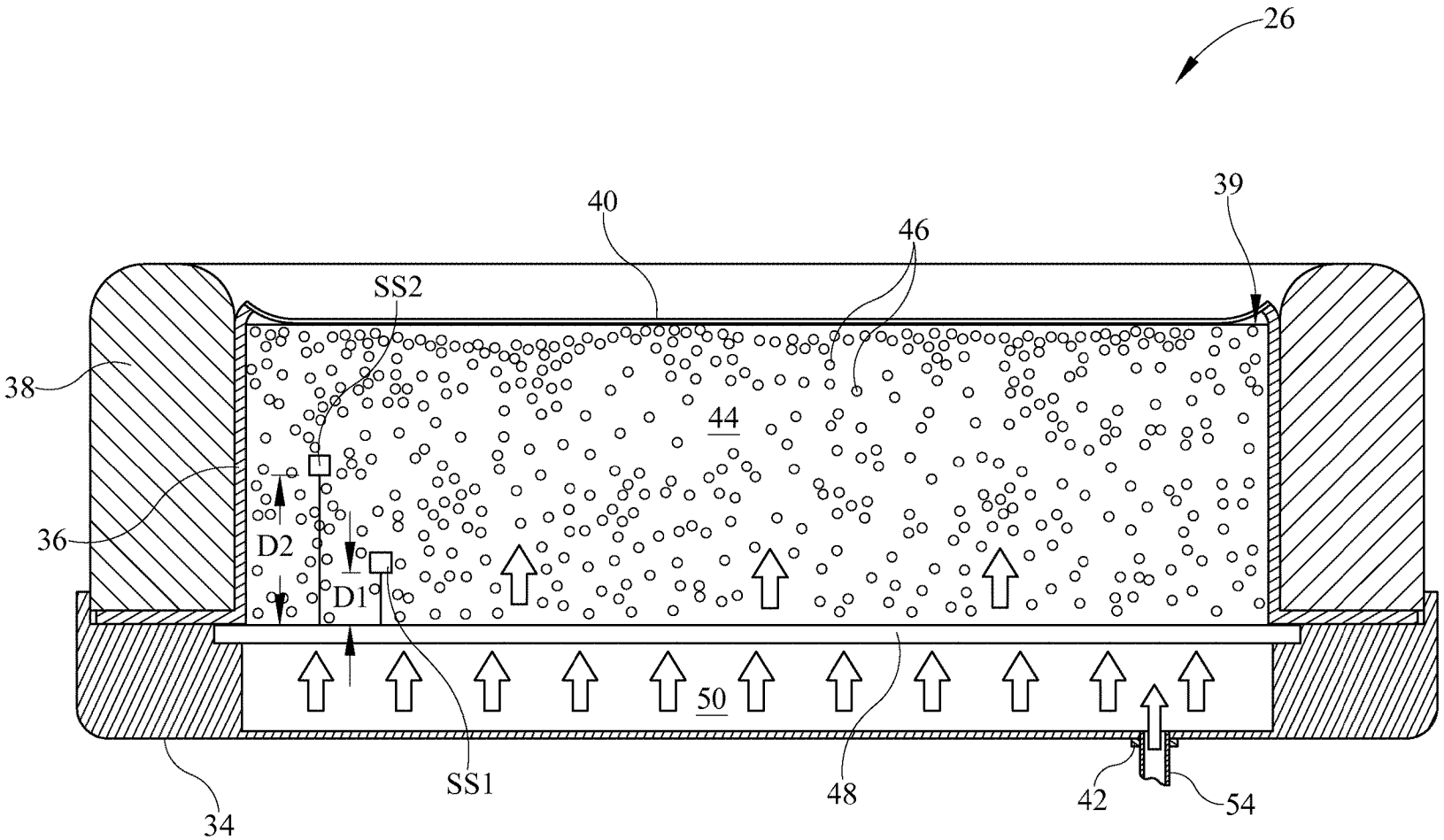
FIG. 7 is a cross-sectional side view of the person support apparatus of FIG. 2 along the width of the person support apparatus showing a plurality of sensors positioned in the fluidizable medium at varying depths.

In another illustrative embodiment, the sensor 56 includes an array of pressure sensors positioned within the fluidizable medium 46 as shown in FIG. 7. In one illustrative embodiment, a first sensor SS 1 is coupled to the diffuser 48 and suspended in the fluidizable medium 46 a first distance D1 from the diffuser 48, for example, about 1 inch, and a second sensor SS2 coupled to the diffuser 48 and suspended in the fluidizable medium 46 a second distance D2 from the diffuser 48, for example, about 5 inches. The first sensor SS1 is configured to measure a first pressure within the fluidizable medium 46 and the second sensor SS2 is configured to measure a second pressure within the fluidizable medium 46. The first pressure and the second pressure can be compared to determine the difference in pressure between the sensors to signify a level of fluidization.

Figure 8:
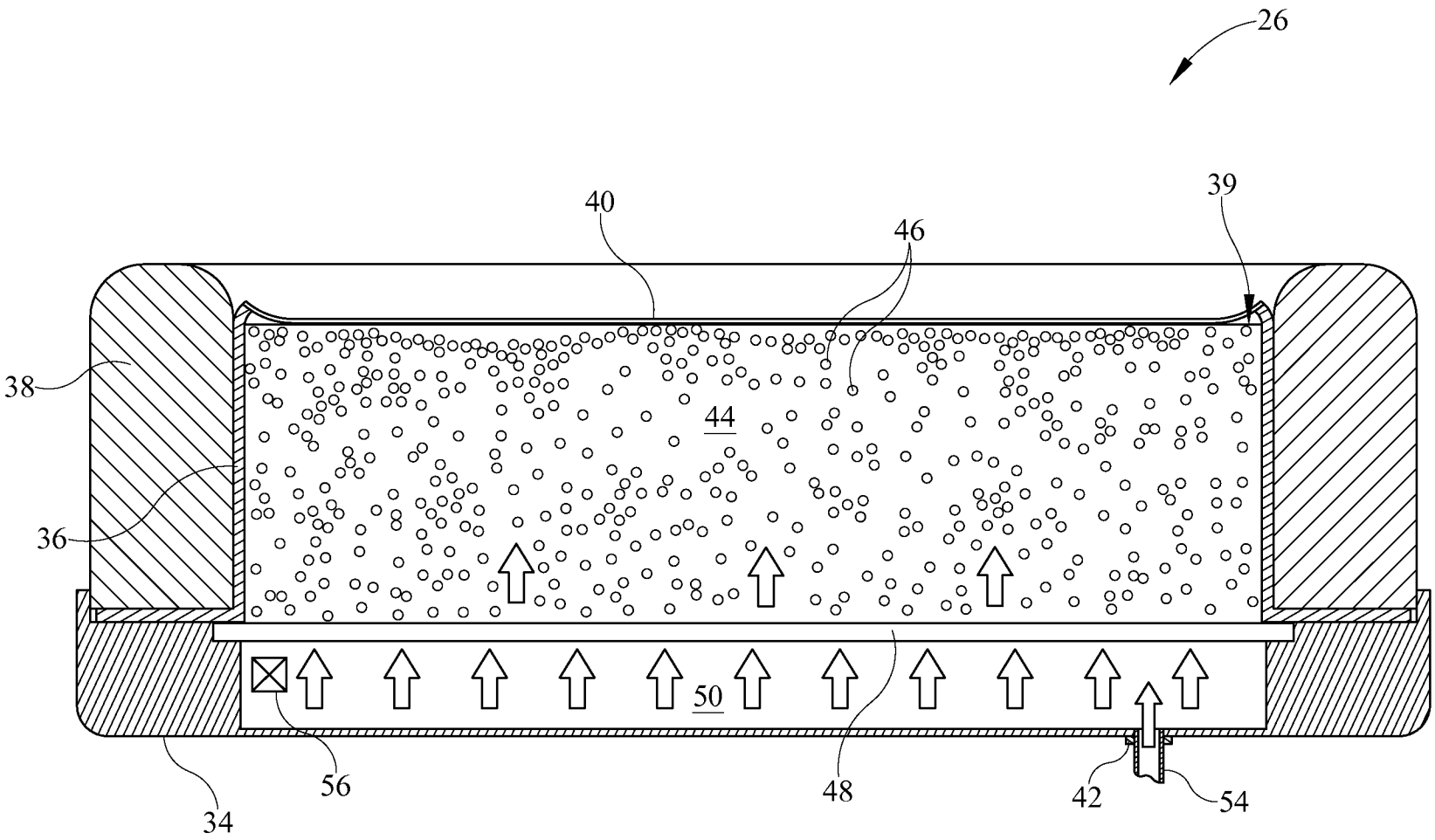
FIG. 8 is a cross-sectional side view of the person support apparatus of FIG. 2 along the width of the person support apparatus showing a sensor positioned in the plenum.

In another illustrative embodiment, the sensor 56 includes a pressure sensor positioned in the plenum 50 and configured to measure the pressure within the plenum 50 as shown in FIG. 8. As the fluidizable medium 46 fluidizes, the rate at which the fluid pressure within the plenum 50 changes is reduced. In some contemplated embodiments, a flow sensor (not shown) is used in combination with the pressure sensor 56 (or any one of the other of sensors described herein) to detect the rate at which fluid is flowing through the fluidizable medium 46 or diffuser 48.

The input device 57 is electrically coupled to the controller 58 as shown in FIG. 3. In one illustrative embodiment, the input device 57 is user interface configured to receive inputs from a user and/or control at least one function of the person support apparatus 10. In another illustrative embodiment, the input device 57 is configured to provide an input to the controller 58 from a device or system external to and/or in communication with the person support apparatus 10, such as, an electronic medical record system (EMR). The information received by the input device 57 can include the depth of the fluidizable medium 46, the weight of the person supported on the person support apparatus 10, or other information about the person or person support apparatus 10. Based on the information from the input device 57, the controller 58 is be able to better calculate what the fluidization threshold is.

The controller 58 is electrically coupled to the fluid supply 52 and the sensor 56 and is configured to control the operation of the fluid supply 52 as a function of one or more input signals from the sensor 56. The controller 58 can determine how to optimize fluidization of the fluidizable medium 46 a number of ways. One way the controller 58 can optimize fluidization is by identifying the location of the fluidization threshold and increasing the fluid flow rate by a predetermined amount. In one illustrative embodiment, the controller 58 calculates what the fluidization threshold is based on the depth of the fluidizable medium and the weight of the person supported thereon. In another illustrative embodiment, the fluid flow rate from the fluid supply 52 is slowly increased from an initial flow rate, for example, 0 CFM, until the input from the sensor 56 indicates that the fluidizable medium 46 is at about the fluidization threshold. Once the fluidization threshold has been determined, the controller 58 increases the fluid flow rate by a predetermined amount, such as, 10-35 CFM, to reach a predetermined desirable level of fluidization. The fluidization threshold can be established during a calibration mode or while a person is supported on the person support structure 10.

Another way the controller 58 can optimize fluidization is by checking the fluidization level as the fluid flow rate is varied. In one illustrative embodiment, the fluid supply 52 is supplying fluid at a first rate FR1 and the sensor 56 sense a parameter indicative of a first level of fluidization FL1. The controller 58 changes the fluid flow rate from the first rate FR1 to a second rate SR1 and the sensors sense a parameter indicative of a second level of fluidization SL1. In one illustrative embodiment, the change in fluid flow rate is ±5-10 CFM. The controller 58 compares the first level of fluidization FL1 to the second level of fluidization SL1 to determine what the pressure drop between the two values is. If the pressure drop is relatively small then the fluid supply 52 is operating in the fluidized region of the curve in FIG. 4, and the controller 58 operates the fluid supply 52 at the lower of the first rate FR1 and the second rate SR1. If the pressure drop is relatively large, then the fluid supply 52 is operating near the fluidization threshold or in the non-fluidized region (shown in FIG. 4 with the first rate FR2, the first level of fluidization FL2, the second rate S2, and the second level of fluidization SL2) and the controller 58 operates the fluid supply 52 at the higher of the first rate FR1 and the second rate SR1.

If neither the first rate FR2 nor the second rate SR2 cause the fluidizable medium 46 to fluidize, then the controller 58 can increase the fluid flow rate until the fluidization threshold is established and then increase the fluid flow rate by a predetermined amount to reach a desired level of fluidization, or the controller can repeat the process of comparing first and second flow rates and levels of fluidization until one of the flow rates generates a desirable level of fluidization. In some contemplated embodiments, the controller 58 can operate the fluid supply 52 at the lower of the first rate FR1 and the second rate SR1 as long as both rates are at or above the fluidization threshold in the fluidized region. In other contemplated embodiments, once a desirable fluidization threshold has been determined and the fluid supply 52 is operating at the appropriate fluid flow rate, a user is able to increase and/or decrease the flow rate within a predetermined therapeutic range, for example, ±20 CFM, as long as level of fluidization remains above the fluidization threshold or the lower end of a predetermined desirable fluidization threshold.

Another way the controller 58 can optimize fluidization is by adjusting the fluid flow rate upon a triggering event occurring. In one illustrative embodiment, the triggering event occurs when the level of fluidization is less than or equal to a predetermined trigger threshold, such as, the fluidization threshold. The level of fluidization can be measured using any of the sensors 56 previously mentioned and the controller 58 can use any method previously mentioned to return the person support apparatus 10 to a desired level of fluidization. In one example, the controller 58 causes the fluid supply 52 to gradually increase the fluid flow rate until the fluidization threshold is established and then increases the fluid flow rate by a predetermined amount to reach a desired level of fluidization. In another example, the controller 58 measures the level of fluidization at the current rate and compares it to a level of fluidization at a higher rate. If the higher rate produces a desired level of fluidization, the controller 58 maintains the fluid flow rate from the fluid supply 52 at that rate. If not, then the process is repeated until a desired fluidization level is reached.

Many other embodiments of the present disclosure are also envisioned. For example, a fluidized person support structure comprises a fluidizable medium, a fluid supply, a sensor, and a controller. The fluid supply is configured to supply fluid that flows through the fluidizable medium. The controller is electrically coupled to the fluid supply and the sensor and is configured to change the rate at which fluid flows through the fluidizable medium from a first rate to a second rate and calculate a desirable flow rate as a function of a first input from the sensor at the first rate and a second input from the sensor at the second rate. The controller causes the fluid supply to supply fluid at the desirable flow rate.

In another example, a fluidized person support structure comprises a fluidizable medium, a fluid supply, a sensor, and a controller. The fluid supply is configured to supply fluid that flows through the fluidizable medium. The controller is electrically coupled to the fluid supply and the sensor and is configured to calculate a desirable flow rate as a function of at least one input from the sensor as the rate at which fluid flows through the fluidizable medium is changed. The controller causes the fluid supply to supply fluid at the desirable flow rate.

In another example, a fluidized person support structure comprises a fluidizable medium, a fluid supply, an input device, and a controller. The fluid supply is configured to supply fluid that flows through the fluidizable medium. The controller is configured to receive an input from the input device and calculate a fluidization threshold as a function of the input. The controller controls the fluid supply as a function of the fluidization threshold.

In another example, a fluidized person support structure comprises a fluidizable medium, a fluid supply, a sensor, and a controller. The fluid supply is configured to supply fluid that flows through the fluidizable medium. The sensor is configured generate a signal indicative of a level of fluidization of the fluidizable medium. A physical property of the sensor changes as the fluidizable medium is fluidized by the fluid. The controller is configured to receive an input from the sensor and control the fluid supply as a function of the input.

In another example, a method of fluidizing a fluidizable medium comprises the steps of: identifying a fluidization threshold of the fluidizable medium; and increasing a rate at which fluid flows through the fluidizable medium as a function of the fluidization threshold.

In another example, a method of fluidizing a fluidizable medium comprising the steps of: changing a rate at which fluid flows through the fluidizable medium; sensing a parameter indicative of a level of fluidization of the fluidizable medium; determining a desirable flow rate as a function of the sensed parameter; and controlling a fluid supply as a function of the desirable flow rate.

In another example, a fluidized person support structure comprises a fluidizable medium, a fluid supply, a sensor, and a controller. The fluid supply is configured to supply fluid that flows through the fluidizable medium. The controller is configured to identify a fluidization threshold as a function of an input from the sensor as the rate fluid supplied by the fluid supply is changed, and control the fluid supply as a function of the fluidization threshold.

In another example, an apparatus for controlling the fluidization level of a fluidized person support apparatus comprises a fluidizable medium, a fluid supply, an input device, and a controller. The fluid supply is configured to communicate a fluid through the fluidizable medium. The controller is configured to receive an input from the input device and calculate a fluidization threshold as a function of the input. The controller controls the fluid supply as a function of the fluidization threshold.

In another example, an apparatus for controlling the fluidization level of a fluidized person support apparatus comprises a fluidizable medium, a fluid supply, a sensor, and a controller. The fluid supply is configured to communicate a fluid through the fluidizable medium. The sensor is configured generate a signal indicative of a level of fluidization of the fluidizable medium. A physical property of the sensor changes as the fluidizable medium is fluidized by the fluid. The controller is configured to receive an input from the sensor and control the fluid supply as a function of the input.

In another example, a method of optimizing fluidization of a fluidizable medium in a person support structure comprises the steps of: upon the occurrence of a triggering event, determining a fluidization threshold of the fluidizable medium; and changing a rate at which fluid flows through the fluidizable medium as a function of the fluidization threshold.

In another example, a method of optimizing fluidization of a fluidizable medium comprises the steps of: identifying a fluidization threshold of the fluidizable medium; and increasing fluidization of the fluidizable medium by a predetermined amount above the fluidization threshold to reach a desired fluidization level.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A system for fluidizing a fluidizable medium, comprising:

a person support structure including a chamber containing a fluidizable medium and a plenum in fluid communication with the chamber, a fluid supply in fluid communication with the plenum, the fluid supply having a variable fluid flow rate;

a sensor sensing the fluid pressure of the fluid in the plenum;

a controller electrically coupled to the sensor and the fluid supply, the controller varying the output of the fluid supply while measuring the fluid pressure within the plenum to achieve a desirable level of fluidization of the fluidizable medium by monitoring the pressure change as the fluid supply flow rate is increased and determining that an acceptable level of fluidization is achieved by detecting that the change in pressure as a function of the increase in fluid supply flow rate is indicative that the system has exceeded a fluidization threshold for the particular operating conditions and maintaining the flow rate of the fluid supply to exceed the fluidization threshold.

2. The system of claim 1, wherein the desirable level of fluidization is proportional to a fluid flow rate of at least about 25 cubic feet per minute (CFM) through the fluidizable medium for a fluidizable medium depth of about 9inches.

3. The system of claim 1, wherein the desirable level of fluidization is proportional to a fluid flow rate of between about 40 CFM and about 65 CFM through the fluidizable medium for a fluidizable medium depth of about 9 inches.

4. The system of claim 1, wherein the desirable level of fluidization is determined as a function of a fluidization threshold of the fluidizable medium.

5. The system of claim 1, wherein the desirable level of fluidization is proportional to a fluid flow rate of between about 25 CFM and about 35 CFM through the fluidizable medium for a fluidizable medium depth of about 9 inches.

6. The system of claim 1, wherein the desirable level of fluidization is proportional to the rate of change of the fluid pressure within the plenum.

7. The system of claim 1, wherein the controller controls the operation of the fluid supply as a function of the difference between the desirable level of fluidization and a level of fluidization of the fluidizable medium sensed by a second sensor that measures movement of the fluidizable medium.

8. The system of claim 1, wherein the desirable level of fluidization includes the fluid flow rate through the fluidizable medium at about a fluidization threshold of the fluidizable medium increased by a predetermined amount.

9. The system of claim 1, wherein the desirable level of fluidization includes the lesser of a first level of fluidization at a first time and a second level of fluidization at a second time so long as the lesser is greater than a fluidization threshold of the fluidizable medium.

10. The system of claim 1, wherein the controller controls the fluid supply as a function of the difference between the pressure in the plenum at a fluidization threshold of the fluidizable medium and a pressure in the plenum at the desirable level of fluidization.

11. The system of claim 1, wherein the desirable level of fluidization includes the lesser of a first level of fluidization at a first time and a second level of fluidization at a second time, if the lesser is less than a fluidization threshold of the fluidizable medium then the lesser is increased by a predetermined amount.

12. The system of claim 1, wherein the controller increases a level of fluidization based on the pressure change as a function of the increase in fluid supply until a fluidization threshold is reached, and further increase the level of fluidization until an acceptable level of fluidization is achieved by detecting that the increase in pressure as a function of the increase in fluid supply has exceeded the fluidization threshold.

13. A system for fluidizing a fluidizable medium, comprising:

a person support structure including a chamber containing a fluidizable medium and a plenum in fluid communication with the chamber, a fluid supply in fluid communication with the plenum, the fluid supply having a variable flow rate;

a sensor positioned within the plenum and sensing the fluid pressure of the fluid in the plenum;

a controller in electrical communication with the sensor and the fluid supply, the controller receiving a signal from the sensor indicative of the fluid pressure in the plenum and controlling the fluid supply to vary the flow rate of the fluid supply, the controller varying the flow rate of the fluid supply such that the rate of change in pressure within the plenum as the flow rate of the fluid supply is increased decreases to a first level that indicates that the flow rate of the fluid supply is sufficient to achieve a desirable level of fluidization of the fluidizable medium, the controller maintaining the flow rate of the fluid supply at the first level to maintain the desirable level of fluidization.

14. The system of claim 13, wherein the desirable level of fluidization is determined as a function of a fluidization threshold of the fluidizable medium.

15. The system of claim 13, wherein the desirable level of fluidization threshold is proportional to the rate of change of the fluid pressure within the plenum.

16. The system of claim 13, wherein the desirable level of fluidization includes the fluid flow rate through the fluidizable medium at about a fluidization threshold of the fluidizable medium increased by a predetermined amount.

17. The system of claim 13, wherein the desirable level of fluidization includes the lesser of a first level of fluidization at a first time and a second level of fluidization at a second time so long as the lesser is greater than a fluidization threshold of the fluidizable medium.

18. The system of claim 13, wherein the desirable level of fluidization is proportional to increasing the pressure in the plenum by a predetermined amount above a fluidization threshold pressure.

19. The system of claim 13, wherein the desirable level of fluidization includes the lesser of a first level of fluidization at a first time and a second level of fluidization at a second time, if the lesser is less than a fluidization threshold of the fluidizable medium then the lesser is increased by a predetermined amount.

20. The system of claim 13, wherein the controller increases a level of fluidization based on the pressure change as a function of the increase in fluid supply until a fluidization threshold is reached, and further increases the level of fluidization until the desirable level of fluidization of the fluidizable medium is reached.

* * * * *